US007726985B2

(12) United States Patent
Gladd et al.

(10) Patent No.: US 7,726,985 B2
(45) Date of Patent: Jun. 1, 2010

(54) SHIELDED ELECTRIC CABLE ASSEMBLY AND METHOD

(75) Inventors: Joseph H. Gladd, Cortland, OH (US); Anthony Raschilla, Girard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/708,446

(22) Filed: Feb. 20, 2007

(65) Prior Publication Data

US 2008/0200070 A1 Aug. 21, 2008

(51) Int. Cl.
*H01R 4/66* (2006.01)

(52) U.S. Cl. ..... 439/98; 439/585; 439/607.5

(58) Field of Classification Search ..... 439/610, 439/99, 98, 607, 585
See application file for complete search history.

(56) References Cited

U.S. PATENT DOCUMENTS 5,707,253 A * 1/1998 Matsumoto et al. ..... 439/610
5,965,847 A * 10/1999 Tanaka et al. ..... 174/84 R
6,152,746 A * 11/2000 Brown ..... 439/99
6,183,303 B1 * 2/2001 Sato ..... 439/610
6,257,931 B1 7/2001 Sakurai
6,544,623 B1 4/2003 Straza
6,648,690 B2 * 11/2003 Saito et al. ..... 439/610
6,659,780 B2 12/2003 Parkinson et al.
6,749,464 B2 6/2004 Obata
6,796,838 B2 9/2004 Yoshioka
6,951,483 B2 * 10/2005 Kameyama ..... 439/595
7,044,756 B1 * 5/2006 Asakura et al. ..... 439/98
2002/0102872 A1 * 8/2002 Kanagawa ..... 439/98
2004/0229508 A1 11/2004 Miyazaki et al.

OTHER PUBLICATIONS

U.S. Appl. No. 11/365,305, filed Mar. 1, 2006, George, Terry A.,. et al.

* cited by examiner

*Primary Examiner*—Hien Vu
(74) *Attorney, Agent, or Firm*—Thomas N. Twomey

(57) ABSTRACT

A shielded electric cable assembly comprises a shielded electric cable and a shield terminal. The shield terminal comprises a ferrule of one-piece construction having an inner ferrule portion and an outer ferrule portion that is radially spaced from the inner ferrule portion and attached to the inner ferrule portion by an end wall. The inner ferrule portion is disposed between an inner insulation jacket of the shielded electric cable and an exposed end portion of an intermediate conductive layer surrounding the inner insulation jacket. The outer ferrule portion is crimped about the exposed end portion of the intermediate conductive layer to crimp the inner ferrule portion tightly around the inner insulation jacket and to clamp exposed end portion of the intermediate conductive layer between the inner ferrule portion and the outer ferrule portion of the one piece ferrule. A conductive cylindrical shell is attached to the one-piece ferrule. An inner terminal which is attached to the cable is disposed in the conductive shell.

11 Claims, 2 Drawing Sheets

SHIELDED ELECTRIC CABLE ASSEMBLY AND METHOD

BACKGROUND OF THE INVENTION

This invention relates generally to a shielded electric cable assembly and a method of making a shielded electric cable assembly.

A shielded electric cable assembly generally comprises a shielded electric cable that has a conductor core that is surrounded by an inner insulation jacket, an intermediate conductive layer, and an outer insulation jacket. A shield terminal is attached to the conductive layer. The conductive layer and shield terminal shield any electronic devices in the vicinity of the shielded electric cable assembly from electromagnetic interference (generally designated EMI) caused by electric current flowing through the conductive core. An inner terminal is usually but not necessarily attached to the conductor core as part of the assembly for making an electrical connection to a mating terminal. The shield terminal of the assembly may include an enlarged conductive shell for shielding the inner terminal and any exposed end portion of the conductor core.

A common shielded electric cable has an intermediate conductive layer in the form of a metallic braid that is woven around the inner insulation jacket. One common inner terminal that may be used in the assembly includes core and insulation crimp wings which are attached to an electric cable in a well known manner in which the core crimp wings are crimped around an exposed end portion of the conductive core while the insulation crimp wings are crimped around the insulation jacket which in the case of a shielded electric cable is an exposed end portion of the inner insulation jacket. Another common inner terminal is an insulation displacement terminal that includes insulation piercing portions for contacting the conductive core without any need for removing an insulation jacket.

U.S. Pat. No. 6,257,931 B1 issued to Kazuaki Sakurai et al. Jul. 10, 2001, discloses a shielded electric cable assembly in FIG. 1. The shielded electric cable assembly comprises a shielded electric cable 2, an inner terminal 4 that is attached to an exposed end portion of a conductor core 3 of the shielded electric cable 2. A shielding terminal 7 is attached to an exposed end portion of a shielding mesh 6 and to an outer insulation jacket 19 of the shielded electric cable 2. The shielded electric cable assembly also includes an inner housing 5 of insulation material to space the inner terminal 4 from the outer shielding terminal 7.

U.S. Pat. No. 6,554,623 B2 issued to Nobuaki Yoshioka Apr. 29, 2003, discloses a shielded electric cable connection in which a shielded electric cable 9 has a terminal that is attached to an exposed end portion of the conductive core and to an exposed end portion of the inner insulation jacket of the shielded electric cable 9. An exposed end portion of the metallic braid 10 is connected to a metal shell 8 by a shield terminal 34 that has a cylindrical part 32 that is caulked to the exposed metallic braid 10.

U.S. Pat. No. 7,204,716 issued to George et al., discloses a shielded electric cable connection in which a shielded electric cable 18 has a terminal 40 that is attached to an exposed end portion of the conductive core 20 and to an exposed end portion of the inner insulation jacket 22 of the shielded electric cable 18. An exposed end portion of the metallic braid 14 is connected to a metal shell 44 by a metal annulus 46 and a clamp ring 48 that is attached to the inner insulation jacket under the exposed end portion of the metallic braid 14.

SUMMARY OF THE INVENTION

In one aspect, the invention provides a shielded electric cable assembly comprises a shielded electric cable and a shield terminal comprising a ferrule of one-piece construction. The ferrule has an inner ferrule portion and an outer ferrule portion that is radially spaced from and integrally attached to the inner ferrule portion by an end wall. The inner ferrule portion is disposed between the inner insulation jacket and an exposed end portion of an intermediate conductive layer, and the outer ferrule portion is crimped about the exposed end portion of the intermediate conductive layer so that the inner ferrule portion is crimped tightly around the outer insulation jacket and the exposed end portion of the intermediate conductive layer is clamped between the inner ferrule portion and the outer ferrule portion.

The shielded electric cable assembly may include an inner terminal that is attached to the shielded electric cable so as to contact the conductive core of the shielded electric cable and/or a conductive shell. The optional inner terminal may be disposed in the optional conductive shell.

In another aspect, the invention provides a method of making a shielded electric cable assembly comprising a shielded electric cable and a shield terminal in which a shield terminal comprises a ferrule of one-piece construction having an inner ferrule portion and an outer ferrule portion that is radially spaced from the inner ferrule portion and attached to the inner ferrule portion by an end wall to define an open ended chamber. The outer insulation jacket of the shielded electric cable is cut and stripped to expose an end portion of the intermediate conductive layer which is flared to space it from an end portion of the inner insulation jacket. The flared exposed end portion of the intermediate conductive layer is positioned between the inner ferrule portion and the outer ferrule portion, and the outer ferrule portion is crimped about the flared exposed end portion of the intermediate conductive layer so that the inner ferrule portion is crimped tightly around the inner insulation jacket and the flared end exposed portion of the intermediate conductive layer is clamped between the inner ferrule portion and the outer ferrule portion of the shield terminal.

An inner terminal may be attached to the shielded electrical cable between the inner ferrule portion and a proximate end of the shielded electric cable and/or a conductive shell may be attached to the ferrule.

DETAILED DESCRIPTION OF THE PREFERRED EMBODIMENTS

Figure 1:
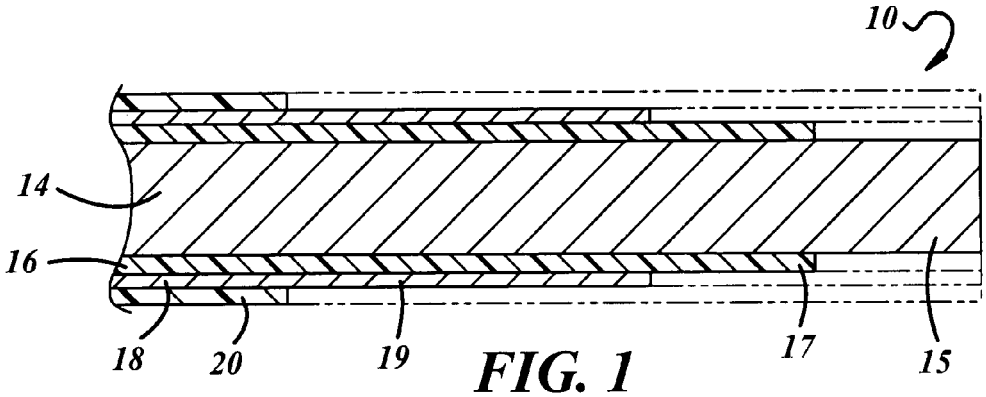
FIG. 1 is a side view of a shielded electric cable that has been prepared for attachment of a shield terminal

Referring now to the drawings, FIG. 1 shows a shielded electric cable 10 that has been prepared for attachment of a shield terminal 12. The shielded electric cable 10 has a conductive core 14, an inner insulation jacket 16 surrounding the conductive core, a intermediate conductive layer 18 surrounding the inner insulation jacket and an outer insulation jacket 20 surrounding the intermediate conductive layer 18.

To prepare the shielded electric cable 10 for attachment of the shield terminal 12, the end portion of the shielded electric cable 10 is cut circumferentially at three axially spaced locations with the cuts successively deeper into the cable 10 so that the three elongated end portions shown in dashed line in FIG. 1 can be stripped away.

The first cut, which is furthest from the end of cable 10, extends through the outer insulation jacket 20 so that the outer elongate end portion shown in dashed line FIG. 1 can be stripped away to provide an exposed end portion 19 of the conductive layer 18. The second cut extends through the intermediate conductive layer 18 as well so that the middle elongate end portion shown in dashed line in FIG. 1 can be stripped away to provide an exposed end portion 17 of the inner insulation jacket 16. The third cut, which is closest to the end of cable 10 extends through the inner insulation jacket 16 as well so that the inner elongate end portion shown in dashed line in FIG. 1 can be stripped away to provide an exposed end portion 15 of the conductive core 14.

The first, second and third cuts may be made simultaneously or successively. Furthermore, the third cut may not be necessary in all cases, for instance when an insulation piercing inner terminal is used as explained more fully below. Moreover, even if the third circumferential cut is made, the end portion of the inner insulation jacket may be removed after the shield terminal 12 is attached as more fully explained below.

Figure 2:
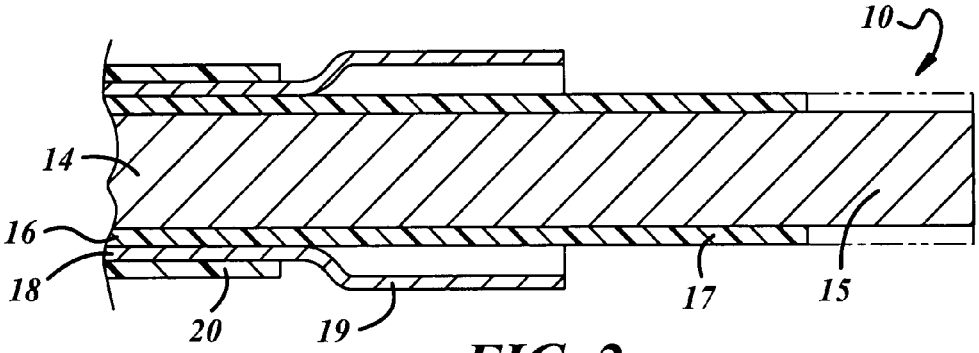
FIGS. 2 and 3 are side views of the shielded electric cable of FIG. 1 and a shield terminal in the process of being applied to the shielded electric cable.

After the shielded electric cable 10 is prepared as discussed above, the exposed end portion 19 of the conductive layer 18 is flared to space it from the exposed end portion 17 of the inner insulation jacket 16, as shown in FIG. 2. The shielded electric cable 10 is now prepared for attachment of the shield terminal 12. It should be noted that the end portion 15 of the conductive core 14 need not be exposed at this time. In fact it may be preferable for the inner insulation jacket 16 to be left intact for assistance in attaching the shield terminal 12 to the cable 10 and/or for providing the option of using an insulation piercing type inner terminal.

Figure 3:
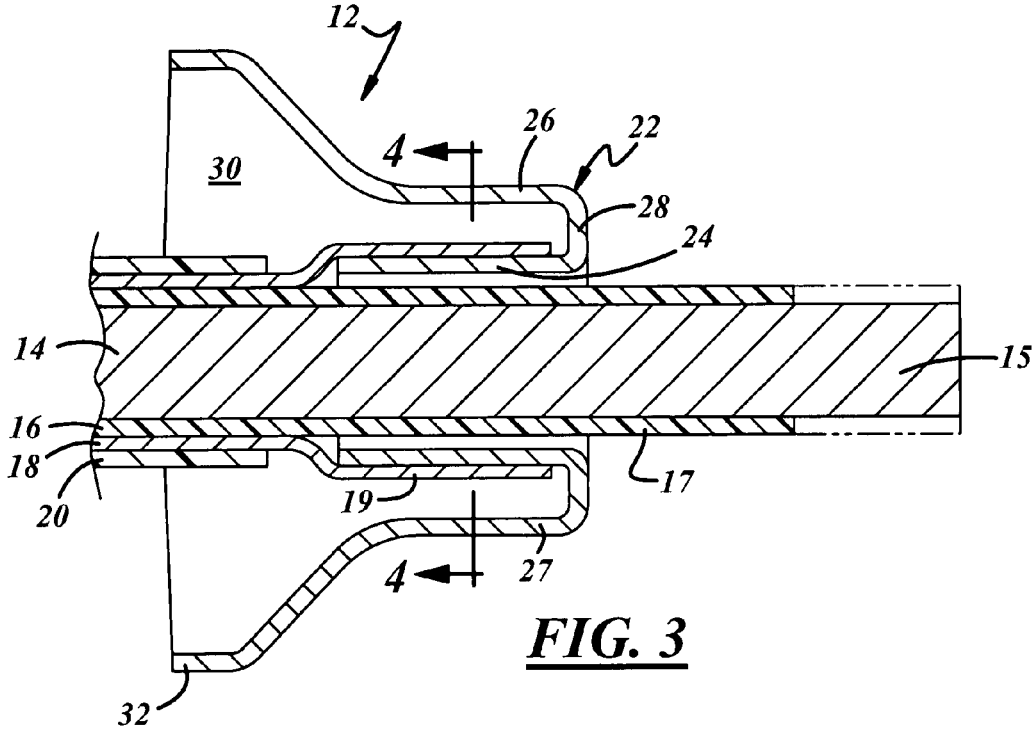
Figure 4:
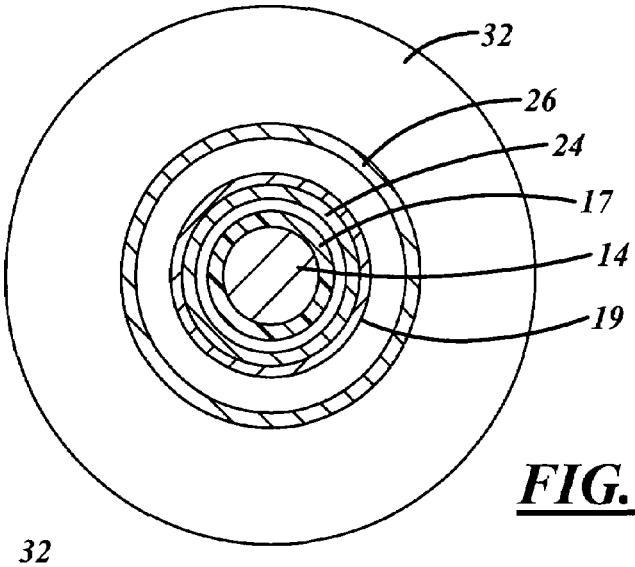
FIG. 4 is a section taken substantially along the line 4-4 of FIG. 3 looking in the direction of the arrows.

Referring flow to FIGS. 3 and 4, the shield terminal 12 comprises a ferrule 22 of one-piece construction having an inner ferrule portion 24 and an outer ferrule portion 26. The outer ferrule portion 26 is radially spaced from the inner ferrule portion 24 and integrally attached to the inner ferrule portion 24 at one end by an end wall 28 to define an open ended chamber 30 for receiving the flared end portion 19 of the conductive layer 18. The opposite open end 32 of the ferrule 22 is preferably substantially larger that than the walled end to facilitate receipt of the end of cable 10 into chamber 30.

After the end portion of the shielded electric cable 10 is prepared as explained in connection with FIGS. 1 and 2, the exposed end portion 17 of the inner insulation jacket 16 is then threaded into the inner ferrule portion 24 of the shield terminal 12 until the inner ferrule portion 24 is disposed between the exposed end portion 17 of the inner insulation jacket 16 and the flared end portion 19 of the conductive layer 18 as shown in FIGS. 3 and 4. As indicated above, the inner insulation 16 may still be intact and covering the conductive core 14 in order to assist in moving the inner ferrule portion 24 into position between the inner insulation jacket 17 and the flared exposed end portion 19 of the conductive layer 18. Leaving the inner insulation layer intact also provides an option for using an insulation displacement type inner terminal as explained below.

Figure 5:
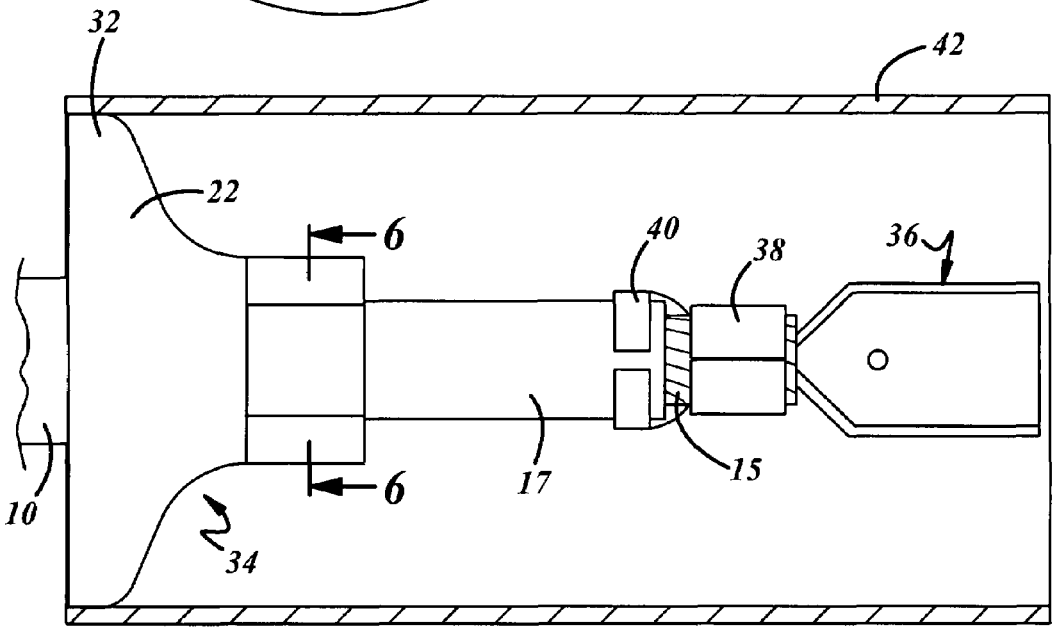
FIG. 5 is a side view of the shielded electric cable and the shield terminal of FIGS. 2 and 3 with the shield terminal shown applied to the shielded electric cable and showing an inner terminal applied to the conductive core of the shielded electric cable.
Figure 6:
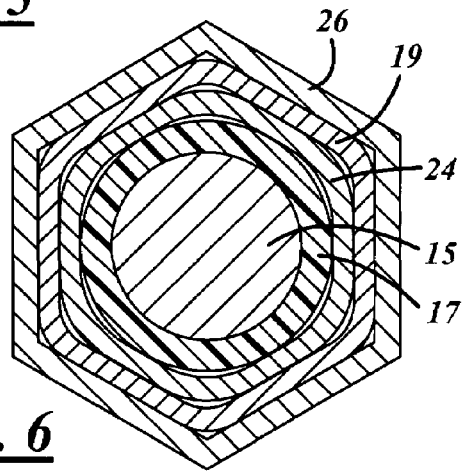
FIG. 6 is a section taken substantially along the line 6-6 of FIG. 5 looking in the direction of the arrows.

After the inner ferrule portion 24 is positioned between the inner insulation jacket 17 and the flared exposed end portion 19 of the conductive layer 18, a ring-like part 27 of the outer ferrule portion 26 is then crimped radially inwardly about the flared end portion 19 of the conductive layer 18 so that the inner ferrule portion 24 is crimped tightly around the end portion 17 of the inner insulation jacket 16 and the flared end portion 19 of the insulation layer 18 is clamped tightly between the inner ferrule portion 24 and the ring like part 27 of the outer ferrule portion 26 of the shield terminal 12 as shown in FIGS. 5 and 6.

While the ring like part 27 of the outer ferrule portion 26 is illustrated as being crimped into a hexagonal shape in FIG. 6, any conventional crimp shape may be used.

The crimp attachment of the one-piece ferrule 22 to cable 10 provides a basic shielded electric cable assembly 34 of the invention. However as shown in FIG. 5, the basic shielded cable assembly 34 may then be enhanced or supplemented by including an inner terminal 36 of any suitable type. The inner terminal 36 which is illustrated is a typical female terminal having core and insulation crimp wings 38 and 40 which are crimped about the exposed end portion 15 of the conductor core 14 and the exposed end portion 17 of the inner insulation jacket 16, respectively. Use of this type of conventional terminal requires the third cut described above wherein the inner insulation jacket 16 is cut through and the inner elongate end portion shown in dotted line in FIGS. 1 and 2 is removed to provide the exposed end portion 15 of the conductor core 14. As indicated above, the inner insulation jacket 17 can be left intact if an insulation displacement type terminal is attached to the cable 10 as part of the shielded electric cable assembly 34.

The shielded electric cable assembly 34 can also be enhanced or supplemented by an enlarged conductive shell 42 that extends past the inner terminal 36. Shell 42 is pressed onto or otherwise suitably secured to the large open end 32 of outer ferrule portion 26 of the shield terminal 12 which is advantageously enlarged to accommodate a cylindrical shell such as the shell 42 shown in FIG. 5.

The shielded electric cable assembly 34 may use a shielded electric cable 10 wherein the intermediate conductive layer 19 is a metallic mesh that is woven around the inner insulation layer 17 or a metal foil or a plastic braid that is coated with a conductive surface. The one-piece ferrule 22 and the optional shell 42 are preferably made of any conductive material that is easily formed such as sheet metal.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A shielded electric cable assembly comprising a shielded electric cable and a shield terminal, the shielded electric cable having a conductive core, an inner insulation jacket surrounding the conductive core, an intermediate conductive layer surrounding the inner insulation jacket, and an outer insulation jacket surrounding the conductive layer, the shield terminal comprising a ferrule of one-piece construction comprising an inner ferrule portion and an outer ferrule portion both the inner ferrule portion and outer ferrule portion being contiguous and uniform about its entire circumference; and free of seams, the outer ferrule portion being radially spaced from the intermediate conductive layer and the inner ferrule portion to form an annular space to receive said intermediate conductive layer before crimping and said outer ferrule portion being integrally attached to the inner ferrule portion by an annular end wall to define an annular chamber having an annular closed end and an open end opposite the closed end to receive said intermediate conductive layer, the inner ferrule portion being disposed between the inner insulation jacket and the exposed end portion of the intermediate conductive layer extending into the chamber through the open end, the outer ferrule portion being crimped about the exposed end portion of the intermediate conductive layer so that the inner ferrule portion is crimped tightly around the outer insulation jacket and the exposed end portion of the intermediate conductive layer is clamped between the inner ferrule portion and the outer ferrule portion, and wherein the outer ferrule portion of the one piece ferrule has a ring-like part adjacent the end wall, an outwardly radially curved extending wall section extending from the ring-like part and an open end at an end opposite the end wall that is larger than the ring-like part.

2. The shielded electric cable assembly as defined in claim 1 wherein the outer ferrule portion has a ring-like part adjacent the end wall that has a substantially hexagonal shape.

3. The shielded electric cable assembly as defined in claim 1 wherein the shielded electric cable assembly further includes an inner terminal that is attached to the shielded electric cable so as to contact the conductive core of the shielded electric cable.

4. The shielded electric cable assembly as defined in claim 1 wherein the shielded electric cable assembly further includes a conductive shell.

5. The shielded electric cable as defined in claim 1 wherein the conductive shell is a separate cylindrical piece that is attached to the open end.

6. The shielded electric cable as defined in claim 1 wherein the shielded electric cable assembly further includes an inner terminal that is disposed in the conductive shell.

7. A method of making a shielded electric cable assembly comprising a shielded electric cable and a shield terminal, comprising the steps of:

providing a shielded electric cable having a conductive core, an inner insulation jacket surrounding the conductive core, an intermediate conductive layer surrounding the inner insulation jacket, and an outer insulation jacket surrounding the intermediate conductive layer, providing a shield terminal comprising a ferrule of one-piece construction comprising an inner ferrule portion and an outer ferrule portion, the outer ferrule portion being radially spaced from the intermediate conductive layer and the inner ferrule portion before crimping, and the outer ferrule portion attached to the inner ferrule portion by an annular end wall to define an annular chamber having an annular closed end and an open end opposite the closed end that has a larger diameter than the annular end wall, said inner and outer ferrule portions being contiguous and uniform about its entire circumference and free of seams, providing the outer ferrule of the one piece ferrule has a ring-like part adjacent the end wall, an outwardly radially curved extending wall section extending from the ring-like part and an open end at an end opposite the end wall that is larger than the ring-like part, cutting the outer insulation jacket and stripping an elongate end portion of the outer insulation jacket to expose an end portion of the intermediate conductive layer, flaring the exposed end portion of the intermediate conductive layer to space the exposed end portion of the intermediate conductive layer from an end portion of the inner insulation jacket, positioning the flared exposed end portion of the intermediate conductive layer in the chamber between the inner ferrule portion and the outer ferrule portion, and crimping the outer ferrule portion about the flared exposed end portion of the intermediate conductive layer so that the inner ferrule portion is crimped tightly around the inner insulation jacket and the flared end exposed portion of the intermediate conductive layer is clamped between the inner ferrule portion and the outer ferrule portion of the shield terminal.

8. The method as defined in claim 7 wherein the outer ferrule portion is crimped into a substantially hexagonal shape.

9. The method as defined in claim 7 wherein the intermediate conductive layer is cut and an end portion stripped to expose an end portion of the inner insulation jacket, wherein the end portion of the inner insulation jacket is threaded into the inner ferrule portion of the shield terminal, and the inner ferrule portion is moved along the inner insulation jacket to position the flared exposed end portion of the intermediate conductive layer between the inner ferrule portion and the outer ferrule portion.

10. The method as defined in claim 7 wherein an inner terminal is attached to the shielded electrical cable between the inner ferrule portion and a proximate end of the shielded electric cable.

11. The method as defined in claim 7 wherein a conductive shell is attached to the ferrule of one-piece construction.

* * * * *